US005083060A

United States Patent [19]

Nugues et al.

[11] Patent Number: 5,083,060

[45] Date of Patent: Jan. 21, 1992

[54] MICROWAVE TUBE PROVIDED WITH AT LEAST ONE AXIAL PART, FITTED COLD INTO A COAXIAL ENVELOPE

[75] Inventors: Pierre Nugues, Auneau; Marc Bizet, Montigny le Bretonneux, both of France

[73] Assignee: Thomson Tubes Electroniques, Boulogne Billancourt, France

[21] Appl. No.: 551,957

[22] Filed: Jul. 12, 1990

[30] Foreign Application Priority Data

Aug. 1, 1989 [FR] France ..... 89 10361

[51] Int. Cl.[5] ..... H01J 25/34

[52] U.S. Cl. ..... 315/3.5; 315/39.3

[58] Field of Search ..... 333/162; 315/3.5, 3.6, 315/5.38, 39.3; 29/600

[56] References Cited

U.S. PATENT DOCUMENTS

| | | | |
|---|---|---|---|
| 2,888,594 | 5/1959 | Moster et al. | 315/3.5 |
| 3,156,845 | 11/1964 | Classe | 315/3.5 |
| 3,271,614 | 9/1966 | Scott | 315/3.5 |
| 3,397,339 | 8/1968 | Beaver et al. | 315/3.5 |
| 3,679,929 | 7/1972 | Holm et al. | 315/5.38 |
| 4,572,985 | 2/1986 | Kuntzmann et al. | 315/3.5 |
| 4,840,595 | 6/1989 | Bibracher et al. | 315/5.38 X |
| 4,947,467 | 8/1990 | Manoly et al. | 315/3.5 |

FOREIGN PATENT DOCUMENTS

| | | |
|---|---|---|
| 0121465 | 10/1984 | European Pat. Off. . |
| 1048635 | 11/1966 | United Kingdom . |

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

A microwave tube provided with at least one axial part, supported by at least three spacers and fitted cold into a coaxial envelope. The internal surface of the envelope or the external surface of the part comprises a relief designed to block a spacer so that the assembly formed by the part and the spacers is clamped in the envelope. The blocking is obtained by a relative shift between at least one spacer and the surface comprising the relief. The axial part may be the gun or the collector of a longitudinal-interaction tube or the delay line of a travelling-wave tube.

9 Claims, 4 Drawing Sheets

FIG. 6a
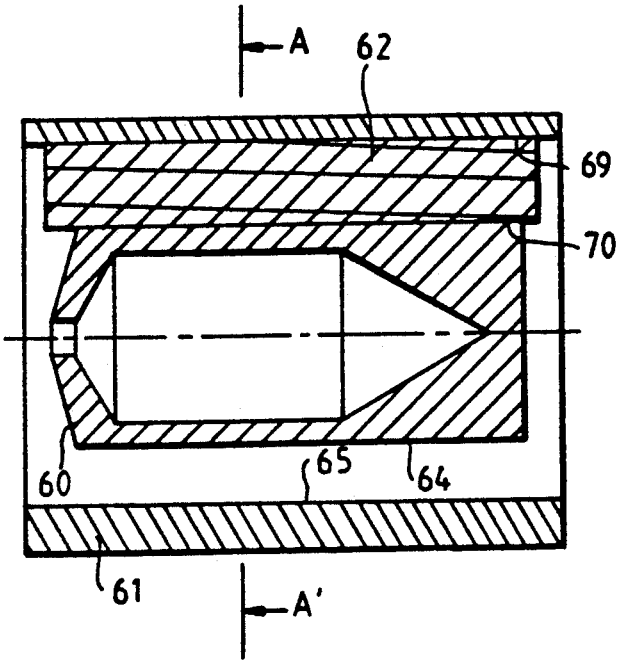
FIG. 6b
A-A'
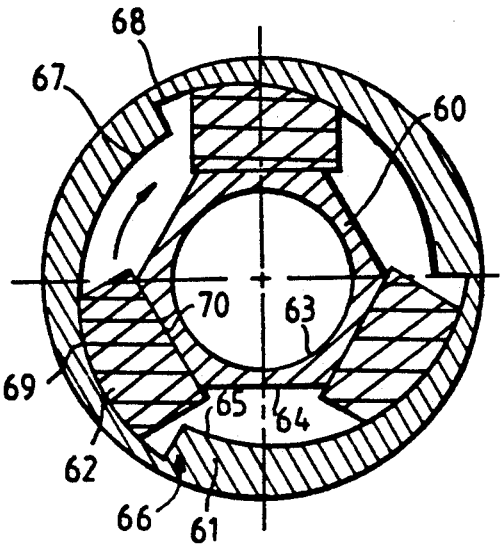
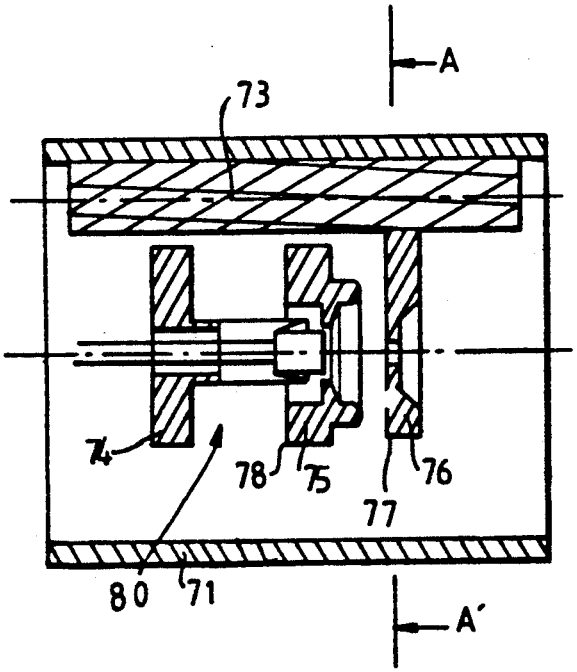
FIG. 7a
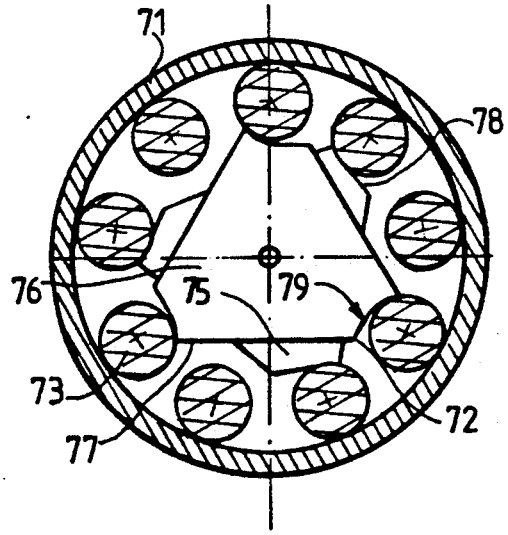
FIG. 7b
A-A'

MICROWAVE TUBE PROVIDED WITH AT LEAST ONE AXIAL PART, FITTED COLD INTO A COAXIAL ENVELOPE

BACKGROUND OF THE INVENTION

1. Field of the Invention

The present invention concerns microwave tubes provided with at least one coaxial part mounted by cold fitting into a coaxial envelope.

The invention can be applied chiefly to the helical delay lines of travelling-wave tubes as well as to the guns or collectors of longitudinal-interaction microwave tubes.

2. Description of the Prior Art

A travelling-wave tube is formed by the association of a long and thin electron beam and a delay line designed to guide a microwave that has to be amplified. This delay line is often helix-shaped. It is metallic. It is kept centered by at least three dielectric spacers in the form of rods and then introduced into a sheath-shaped metal envelope. The helix may be formed by several successive sections. Attenuations may be deposited on the rods, at two ends of facing helical sections. This makes it possible to prevent the tube from oscillating, and that increases its gain.

The electron beam is produced by a gun placed at input of the delay line, and it is collected in a collector placed at output of the delay line. A focusing device surrounds the delay line so as to make the electron beam converge.

The sheath often has the shape of a cylinder generated by revolution. It is coaxial with the helical delay line. The sheath may be formed by successive metal rings. It enables a high vacuum to be maintained within the tube, and can also act as a focusing unit.

When the travelling-wave tube works in continuous mode, the helix is greatly heated. This heating is due to the power released by the electrons of the beam which strike the helix, and to the Joule's effect losses from the helix. This heating is related to the mean power level of the tube.

In order to limit this heating, it becomes necessary, firstly, to choose suitable materials for the helix, the rods and the sheath and, secondly, to provide for excellent contact between the helix and the rods, and between the rods and the sheath The helix is often made of tungsten or molybdenum, the rods are made of boron nitride, alumina or beryllium oxide, and the rings of the sheath are made alternately of iron and stainless steel.

At present, there are two main methods used to mount the helix surrounded by the rods in the sheath.

The first method consists in force-fitting the helix/-rods assembly into the sheath. This method calls for very precise control of the dimensions of the parts to obtain satisfactory clamping or gripping. Their have to be extremely low, of the order of 5 to 7 micrometers.

The second method that is frequently used consists in heating the sheath so that it expands and then in inserting the helix/rods assembly within it. The clamping is obtained upon cooling. Under heat, the clearance needed to enable the insertion of the helix/rods assembly is in the range of 0.02 to 0.03 millimeters. However, this method has serious drawbacks.

Its implementation is lengthy and difficult. The sheath has to be heated to about 700 degrees C. The heating operation takes several hours, and so does the cooling operation. When the helix/rods assembly is inserted into the heated sheath, there is a risk that the attenuations deposited on the rods will be damaged by oxidation. As compared with the first method, this method calls for relatively strict tolerances of parts.

SUMMARY OF THE INVENTION

The present invention seeks to overcome these drawbacks and proposes a microwave tube provided with at least one axial part mounted in an envelope by cold fitting. This mounting requires neither heating nor prior deformation of the part or envelope. The requisite tolerances are larger than in the prior art.

The present invention proposes a microwave tube provided with at least one axial part fitted into a coaxial envelope and kept centered in this envelope by spacers placed between the external surface of the axial part and the internal surface of the envelope, wherein the external surface of the axial part and the internal surface of the envelope are shaped so that the axial part and the spacers can be freely introduced into the envelope in a first relative radial position of these parts and so that a force clamping the spacers between the external surface of the axial part and the internal surface of the envelope is exerted during the relative rotation of these parts from the first position up to a second relative radial position of these parts.

According to one mode of construction, the internal surface of the envelope is formed by a succession of cylindrical sectors with gradually decreasing radii.

According to one variant, the internal surface of the envelope may be formed by cylindrical sectors separated by protuberances, each protuberance being surmounted by a groove.

According to another variant, the internal surface of the envelope may be formed by on cylindrical sector and one protuberance surmounted by a groove.

According to another variant, the external surface of the axial part is formed by faces of a prism that are separated by concave surfaces. The internal surface of the envelope and/or the external surface of the axial part are obtained by broaching, drawing or machining.

The microwave tube may be a travelling-wave tube, the axial part being a helical delay line and the envelope being a sheath.

The axial part may also be the gun or the collector of a longitudinal-interaction tube.

BRIEF DESCRIPTION OF THE DRAWINGS

The invention will be understood more clearly and other characteristics and advantages will appear from the following description, illustrated by the appended figures, of which:

FIG. 6*a* shows a longitudinal section of a collector of a microwave tube according to the invention;

FIG. 6*b* shows a cross-section of the same collector;

FIG. 7*a* shows a longitudinal section of an electron gun of a microwave tube according to the invention;

DETAILED DESCRIPTION OF THE INVENTION

Figure 1:
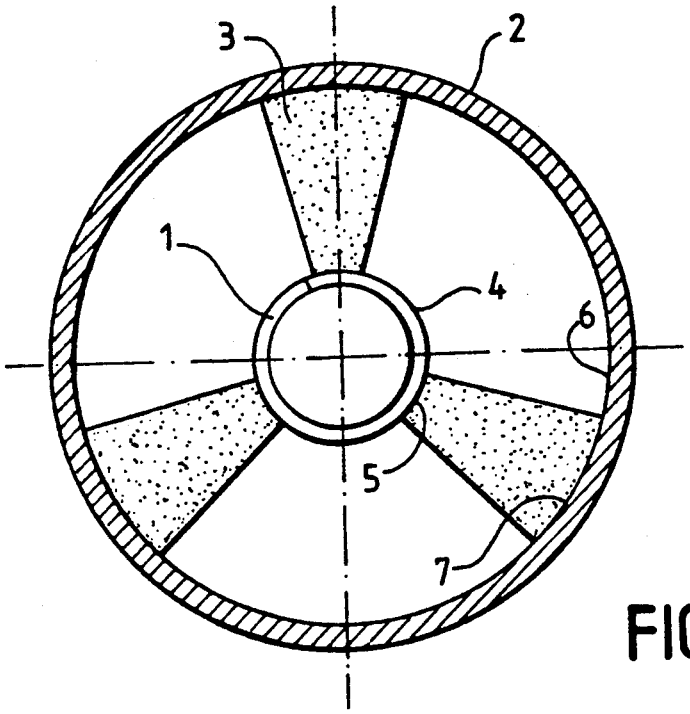
FIG. 1 shows a cross-section of a helical delay line of a travelling-wave tube according to the prior art.

FIG. 1 shows a cross-sectional view of a helical delay line of a travelling-wave tube, mounted coaxially in a metal sheath 2. The helix bears the reference 1. This helix 1 is supported by at least three dielectric rods 3 that enable it to be centered in the sheath 2. They also provide for the clamping of the helix/rods assembly in the sheath 2.

The sheath 2 is shown as having the shape of a cylindrical tube.

The mounting of the helix 1 in the sheath 2 is often done under heat. The sheath 2 is heated, and it expands. The helix/rods assembly can be inserted into it. The required clamping is obtained during the cooling of the sheath 2.

In order to limit the heating of the helix when the microwave tube is in operation, excellent contact must be provided between, firstly, the external surface 4 of the helix 1 and a first face 5 of the rods 3 and, secondly, between a second face 7 of the rods 3 and the internal face 6 of the sheath 2. The faces 5, 7 are opposite to each other. The dimensions and shapes chosen for the two faces 5, 7 will be such so that they respectively match the external face 4 of the helix 1 and the internal surface 6 of the sheath 2. In the figure, the external surface 4 of the helix 1 and the internal surface 6 of the sheath 2 are cylindrical. The rods 3 have a substantially trapezoidal cross-section. They are evenly spaced out around the helix 1.

Figure 2:
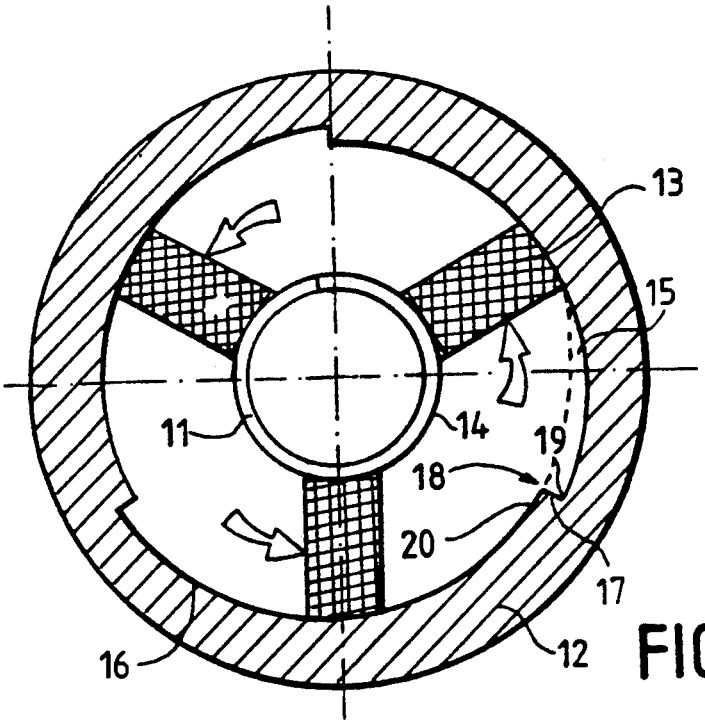
FIG. 2 shows a cross-section of a helical delay line of a travelling-wave tube according to the invention.

FIG. 2 represents a cross-section of a helical delay line of a travelling-wave tube according to the invention, mounted in a coaxial sheath 12. The helix bears the reference 11. The helix 11 is supported by at least three dielectric rods 13 which center it in the sheath 12. These rods 13 also provide for clamping the helix/rods assembly in the sheath 12. They have a substantially rectangular cross-section. The sheath is made with a cylindrical metal tube. Now, the internal surface 16 of the sheath 12 has at least one relief 18. This relief 18 is designed to block at least one rod 13 so as to provide for the radial clamping of the helix/rods assembly in the sheath 12. The relief 18 has at least one blocking zone 20.

In FIG. 2, the internal surface of the sheath 12 has a succession of cylindrical sectors with gradually decreasing radii. These cylindrical sectors are substantially identical.

This internal surface defines reliefs 18 each having a blocking zone 20, followed by a notch 19. This notch 19 is parallel to the axis of the sheath 12. As many reliefs 18 as there are rods 13, i.e. three reliefs 18, have been shown.

The notches 19 have been made by broaching or machining within the tube, the thickness of which has been chosen accurately. One side 17 of each notch 19 extends along a radius of the tube.

FIG. 2 shows a half-crescent shaped surface 15 indicated by a line of dashes. It is against the side 17. This surface 15 corresponds to the material removed when making a notch 19.

When the helix/rods assembly is clamped in the sheath, each of the rods will be in contact by one side with the helix 11 and by the other side with the sheath 12 in a blocking zone 20 in the vicinity of a notch 19. The dimensions of the rods 13 that have to be blocked at a relief 18 will be chosen appropriately. The rods are distributed preferably evenly around the helix 11. The reliefs 18 are arranged so that a rod 13 comes into contact with a blocking zone 20.

This figure is only an example, and the possible shapes of the reliefs 18 are extremely varied. It is enough for the reliefs 18 to extend throughout the length of the sheath for the heat produced by the helix to be removed efficiently.

It is possible to envisage making a sheath such as this by drawing, in using an appropriate draw die.

The mounting of the helix/rods assembly in the sheath is then very simple. It is enough to position the rods 13 around the helix 11 and then insert the assembly, taking care to place the rods in a cleared zone. In FIG. 2, a cleared zone corresponds, for example, to a notch 19.

The rods are blocked by a relative shift of the rods 13 with respect to the surface comprising the reliefs 18. Here, the helix/rods assembly will be rotated in the direction of the arrow until each rod 13 comes into contact with a blocking zone 20.

During this rotation, the sheath is fixed. If the helix/rods assembly now remains fixed and the sheath 12 rotates on itself, the same result is obtained. An outfit adapted to the purpose can be used to achieve these rotational motions. It shall be described in FIGS. 5*a* and 5*b*.

The mounting is done cold and the risk of deterioration, by oxidation, of the attenuations deposited on the rods is considerably reduced.

Figure 3:
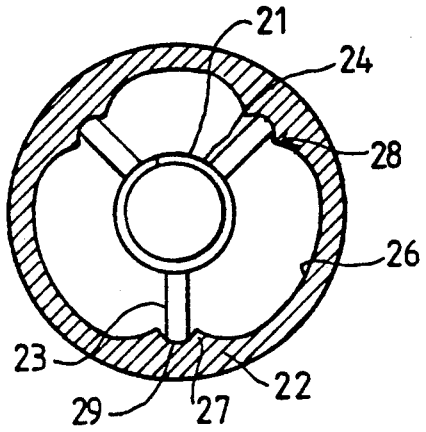
FIG. 3 shows a cross-section of a first variant of a helical delay line of a travelling-wave tube according to the invention.

FIG. 3 shows a cross-section of a helical delay line of a travelling-wave tube according to the invention. The helix 21 is mounted in a sheath 22. The sheath is a cylindrical tube coaxial with the helix. The helix 21 has a cylindrical external surface 24. The helix 21 is supported by three dielectric rods 23 which keep it clamped and centered within the sheath 22.

The internal surface 26 of the sheath 22 includes reliefs 28, equal in number here to the rods 23. Each of these reliefs 28 is designed to block a rod. They have at least one blocking zone. For easier construction and mounting, the reliefs 28 are identical, but it could have been otherwise. The shape and the dimensions of the rods are matched with the reliefs. Each relief 28 is formed by a protruberance 27. The peak of this protuberance 27, pointed towards the center of the sheath, has a groove 29. It is in this groove 29 that the rod 23 will get housed. The bottom and/or the sides of this groove 29 form the blocking zone. The reliefs 28 are evenly distributed on the inner surface of the sheath.

Figure 4:
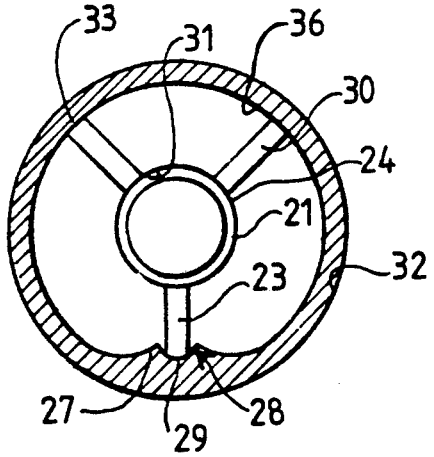
FIG. 4 shows a cross-section of a second variant of a helical delay line of a travelling-wave tube according to the invention.

FIG. 4 shows another variant of a helical delay line mounted in a sheath 32. The elements of this figure are practically similar to those of FIG. 3. The identical elements bear the same references. There are three rods 23, 30. A single rod 23 is blocked by a relief 28, identical to that of FIG. 3. The sheath 32 has an internal surface 36 that is cylindrical except at the relief 28.

The other two rods 30 have a face 31 in contact with the external face 24 of the helix 21 and another face 33 in contact with the internal surface 36 of the sheath 32. The faces 31 and 33 are opposite to each other. The rod 23 and the rods 30 do not have the same dimensions.

Figure 5A:
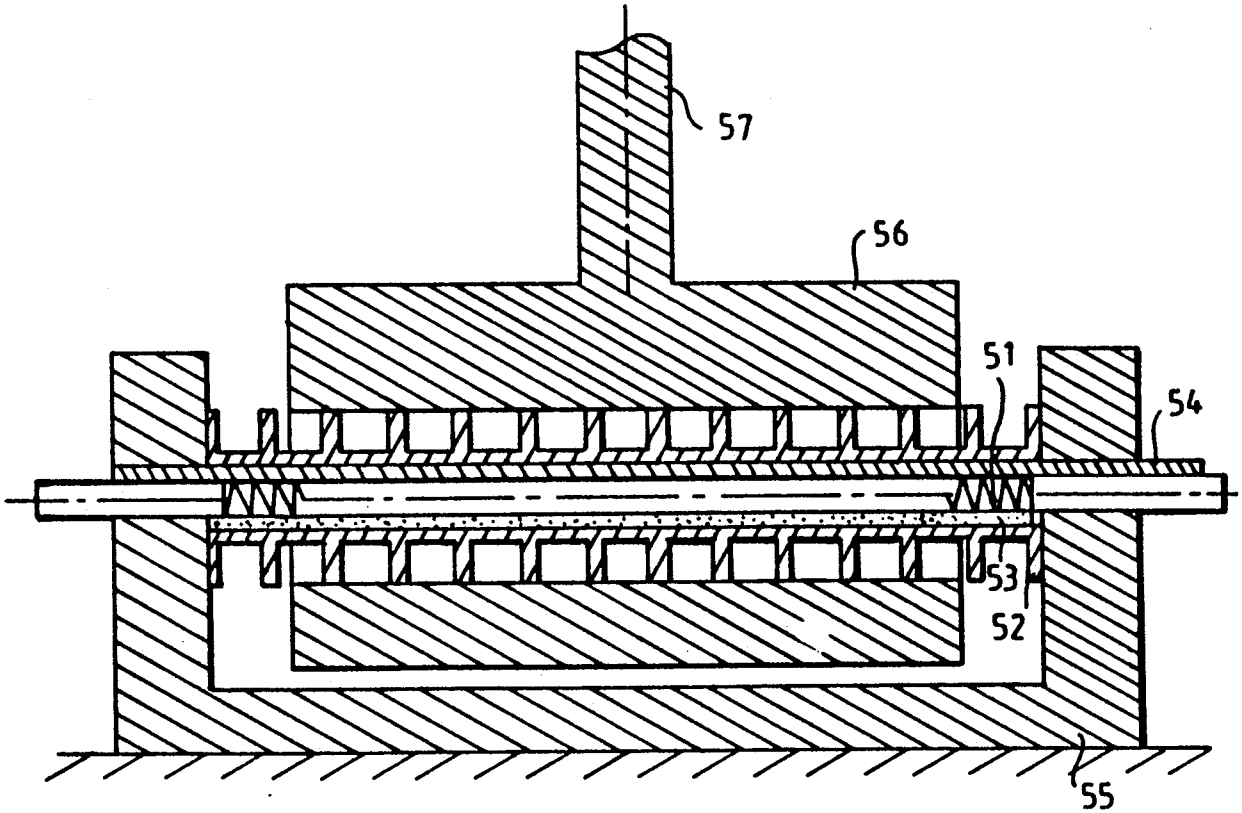
FIG. 5*a* shows a longitudinal section of a outfit enabling the clamping of a helix/rods assembly in a sheath.
Figure 5B:
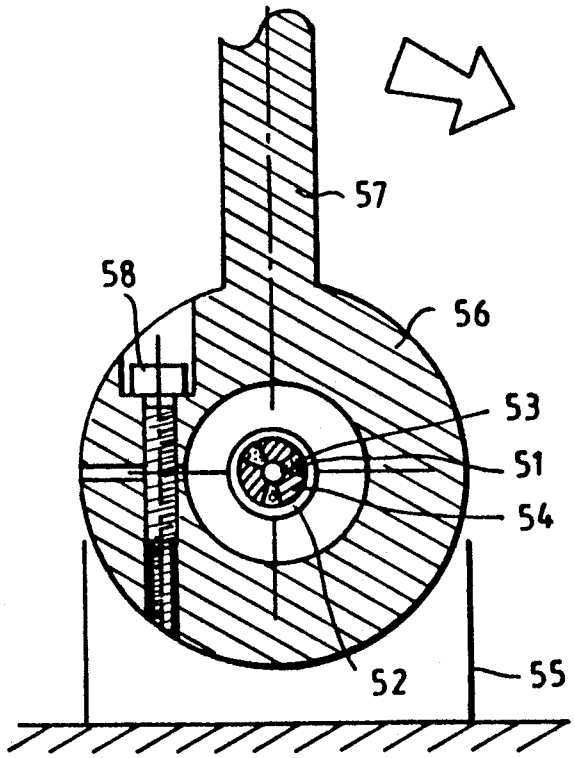
FIG. 5*b* shows a cross-section of the same outfit.

FIG. 5*a* and FIG. 5*b* respectively show a longitudinal section and a cross-section of an outfit suited to the mounting of the axial parts of a microwave tube according to the invention in an envelope. The example described enables the mounting of a helical delay line 51 in a sheath 52. The sheath 52 also acts as a focusing device. At least three rods 53 support the helix and ensure proper clamping in the sheath 52.

A template 54 is placed between two consecutive rods 53. This template occupies the entire space between the two rods 53, the helix 51 and the sheath 52. There are three templates 54. These templates are longer than the helix and are fixed to a frame 55.

The sheath 54 is grasped in a mandrel 56 having a handle 57 that can be shifted. The shifting of the handle 57 draws the mandrel 56 and the sheath 52 in a rotational motion. The helix/rods assembly remains fixed by means of the templates 54 that are fixedly joined to the frame 55 The rotational shifting of the sheath 52 enables the rods to get blocked. The tightening of the mandrel 56 around the sheath 52 can be done by a screw system 58.

The handle may include a torque wrench so as to check the clamping.

It is also possible to envisage an arrangement where, on the contrary, the sheath remains fixed by being held in a fixed mandrel and the helix/rods assembly shifts rotationally by means of a rotational motion applied to the templates. Such a outfit is not shown.

The present invention can be applied to any microwave tube provided with an axial part mounted in a coaxial envelope. This part may be, for example, a gun or a collector of a longitudinal-interaction tube. The invention is not limited to a delay line.

A longitudinal-interaction microwave tube has a gun producing a longitudinal electron beam. This electron beam goes through a microwave structure and is then collected in a collector.

FIGS. 6*a* and 6*b* respectively represent a longitudinal section and a cross-section of a collector 60 of a longitudinal-interaction microwave tube. This collector 60 has the general shape of a hollow cylinder placed in the extension of the axis of the tube. The collector 60 is metallic. It is mounted in a coaxial envelope 61. This envelope 6 provides for imperviousness between the interior and the exterior of the tube. For, a high vacuum prevails inside the tube.

The collector 60 is supported by at least three rod-shaped spacers 62 with a substantially rectangular cross-section. They are made of a material that is both electrically insulating and a good conductor of heat. In collecting an electron beam, the collector 3 gets heated considerably, and this heat must be removed towards the envelope 61. As a consequence, excellent contact is sought between the collector 60 and the spacers 62, on the one hand, and between the spacers 62 and the envelope 61 on the other hand. Suitable clamping of the collector/spacers assembly in the envelope is sought.

The internal surface 63 of the collector 60 is cylindrical while its external surface 64 is hexagonal.

Two opposite sides 69, 70 of a spacer 62 are respectively in contact with the envelope 61 and the collector 60. The side 70 is totally in contact with a side of the hexagon.

The envelope 61 is a cylindrical tube that is coaxial with the collector 60. Its internal surface 65 has at least one relief 66. As many reliefs 66 as there are spacers 62 have been shown. Their number could be smaller or greater.

These reliefs 66 have the same shape as those shown in FIG. 2 The blocking zone 67 and the notch 68 can be seen. This relief is designed to block a spacer 62 so that the collector/spacers assembly can be clamped in the envelope 61.

The collector 60 is mounted in the envelope 61 in the same way as the helix.

The collector/spacers assembly is inserted into the envelope 61, care being taken to place the spacers 62 in a cleared zone. This is what is shown in FIG. 6*b*. The spacers are close to the notch 68. The blocking is obtained by a shifting of the collector/spacers assembly in the direction of the arrow, until the spacers 62 are held fixed at a blocking zone 67.

This is a rotational motion. During this motion, the envelope 61 is fixed. The envelope 61 could also have been shifted rotationally, with the collector/spacers assembly remaining fixed.

FIGS. 7*a*, 7*b* respectively show a longitudinal section and a cross-section of an electron gun 80 of a longitudinal-interaction microwave tube. This gun 80 is placed in the extension of the axis of the tube and is mounted in a coaxial envelope 71.

The electron gun has a cathode 74 that emits an electron beam towards an anode 76. We have shown another electrode 75 which can be used for the pulse modulation of the electron beam. The anode 76 and the electrode 75 are pierced at their center to let the electron beam through. The electron beam is not shown.

The gun 80 is supported by at least three spacers 73. Herein, the electrodes 74, 75, 76 are each supported by three spacers 73. These spacers 73 isolate the electrodes 74, 75, 76 from one another. They are generally made of ceramic and have the shape of cylindrical rods. They enable the gun 80 to be centered in the envelope 71.

The envelope 71 is generally made of metal, such as soft iron for example. It is used to maintain the high vacuum within the gun, and also fulfils a magnetic role. The envelope is a tube, and its internal surface is cylindrical FIG. 7*b*, which is a cross-section, shows two of the electrodes 75, 76. They have the shape of a right prism, the cross-section of which is substantially an isosceles triangle. Each ridge of the prism is cut by a substantially concave surface 72.

Now, it is the external surface 77, 78 of the electrodes 76, 75 that has at least one relief 79 designed to block a spacer 73. The reliefs 79 are formed herein by concave surfaces 72. There are as many reliefs 79 as there are spacers 73, and these are all identical. These concave surfaces 72 also form the blocking zones.

The mounting of the gun is comparable to that described earlier. The spacers are placed around electrodes, and then the electrodes/spacers assembly is introduced into the envelope 71, in seeing to it that the spacers are at a distance from the blocking zones. Finally, each electrode 74, 75, 76 is rotationally driven separately so that the spacers get blocked. The envelope remains fixed, and so do the spacers. An outfit adapted to the purpose, comparable to the one described in FIGS. 5*a* and 5*b*, will be used.

The present invention enables a reduction in the cost of the microwave tube through a reduction in the time taken for its assembly. The cost of the elements used (axial parts, spacers, envelope) is also reduced. The required tolerances are greater than in the prior art. Tolerances of 0.1 to 0.2 millimeters are acceptable.

The use of fluids such as hydrogenated nitrogen to prevent oxidation is no longer necessary with this cold mounting.

The axial parts may be mounted in envelopes belonging to already assembled sub-assemblies and possibly having microwave windows for example. In the prior art, under heat, the brittle parts were assembled at a later stage, in order to prevent their breakage.

The invention is not limited to the examples described, especially as regards the shapes of the reliefs, the spacers, the internal surfaces of the envelopes and the external surfaces of the axial parts.

What is claimed is:

1. A microwave tube provided with at least one axial part fitted into a coaxial envelope and kept centered in the envelope by spacers placed between an external surface of the axial part and an internal surface of the envelope, wherein the external surface of the axial part and the internal surface of the envelope are shaped so that the axial part and the spacers can be freely introduced into the envelope in a first relative position of said envelope, said axial part and said spacers, so that a force clamping the spacers between the external surface of the axial part and the internal surface of the envelope is exerted during a relative rotation of at least one of said envelope, said axial part and said spacers from the first position to a second relative position of said envelope, said axial part and said spacers.

2. A microwave tube according to claim 1, wherein the internal surface of the envelope is formed by a succession of cylindrical sectors with gradually decreasing radii.

3. A microwave tube according to claim 1, wherein the internal surface of the envelope is formed by cylindrical sectors separated by protuberances, each protuberance being surmounted by a groove.

4. A microwave tube according to claim 1, wherein the internal surface of the envelope is formed by one cylindrical sector and one protuberance surmounted by a groove.

5. A microwave tube according to claim 1, wherein the external surface of the axial part is formed by faces of a prism that are separated by concave surfaces.

6. A microwave tube according to one of claims 1-5, wherein the internal surface of the envelope and the external surface of the axial part may be obtained by broaching, wire-drawing or machining.

7. A microwave tube according to claim 1, wherein said microwave tube is a travelling-wave tube, the axial part being a helical delay line and the envelope being a sheath.

8. A microwave tube according to claim 1, wherein said microwave tube is a longitudinal-interaction tube, the axial part being an electron gun.

9. A microwave tube according to claim 1, wherein said microwave tube is a longitudinal-interaction tube, the axial part being a collector.

* * * * *